US005162001A

United States Patent [19]

Harwath et al.

[11] Patent Number: 5,162,001

[45] Date of Patent: Nov. 10, 1992

[54] SHIELDED ELECTRICAL CONNECTOR

[75] Inventors: Frank A. Harwath, Downers Grove; Donald J. Brinkman, Woodridge; David L. Brunker, Naperville, all of Ill.; Richard A. Johnson, Poughkeepsie, N.Y.; Glenn A. Landgraf, Naperville, Ill.; Howell B. Schwartz, Poughkeepsie; Basil D. Washo, Poughkeepsie, both of N.Y.

[73] Assignee: Molex Incorporated, Lisle, Ill.

[21] Appl. No.: 791,866

[22] Filed: Nov. 13, 1991

[51] Int. Cl.[5] ..... H01R 13/648

[52] U.S. Cl. ..... 439/608; 439/108

[58] Field of Search ..... 439/607, 608, 609, 610, 439/55, 92, 78, 101, 108

[56] References Cited

U.S. PATENT DOCUMENTS

| | | | |
|---|---|---|---|
| 3,329,925 | 7/1967 | Johnson et al. | 439/610 X |
| 3,848,164 | 11/1974 | Otte | 439/610 X |
| 4,451,107 | 5/1984 | Dola et al. | 439/608 |
| 4,720,770 | 1/1988 | Jameson | 439/609 X |
| 4,734,058 | 3/1988 | Pavlacka | 439/607 |
| 4,889,500 | 12/1989 | Lazar et al. | 439/579 |
| 4,897,046 | 1/1990 | Tengler et al. | 439/579 |
| 4,941,833 | 7/1990 | Noschese et al. | 439/92 |
| 4,941,853 | 7/1990 | Harwath | 439/848 |
| 4,964,814 | 10/1990 | Tengler et al. | 439/607 |

OTHER PUBLICATIONS

Research Disclosure, Apr. 1991, 32446.

*Primary Examiner*—Larry I. Schwartz
*Assistant Examiner*—Khiem Nguyen
*Attorney, Agent, or Firm*—Charles S. Cohen

[57] ABSTRACT

An electrical connector is disclosed for interconnection to a printed circuit board having signal traces and ground circuitry thereon. The connector includes signal contacts for termination to the signal traces on the printed circuit board. A conductive housing has receptacles, including insulators, for mounting the signal contacts therein. A plurality of ground projections are formed integral with the housing for interconnection to the ground circuitry on the printed circuit board.

21 Claims, 3 Drawing Sheets

SHIELDED ELECTRICAL CONNECTOR

FIELD OF THE INVENTION

This invention generally relates to the art of electrical connectors and, particularly, to a shielded electrical connector for interconnection to a printed circuit board having signal traces and ground traces thereon.

BACKGROUND OF THE INVENTION

Electrical connectors are provided for termination of coaxial cables and for electrical connection of the cables to a printed circuit board or other device. With increasing signal requirements, connectors must terminate a large number of cables while controlling impedance between the cables and the printed circuit board. With the ever increasing densities of electrical contacts to accommodate an ever increasing number of signals within a given area of a printed circuit board, particularly in data processing and telecommunications applications, it has become increasingly difficult to design such electrical connector assemblies. The area allowed for such applications continues to decrease. This combination of requirements leading to such an increased density of the signal leads results in an ever increasing noise potential and greater problems in shielding the leads to prevent or reduce "crosstalk" between the signal contacts. Still further, it is necessary to simultaneously maintain a matched impedance from the site of cable termination into the printed circuit board through the region of interconnection.

With such intertwined problems, the predominant design of electrical connector assemblies of the character described involves the utilization of both individual signal contacts and individual ground pin contacts within a connector receptacle, the signal contacts and ground pin contacts being terminated to signal traces and ground traces, respectively, on the printed circuit board. Some attempts at improving the density of such connector assemblies have involved the use of a honeycomb grounding block and the utilization of air as the dielectric between the contacts and pins and the block. Such an approach is shown in Lazar U.S. Pat. No. 4,889,500, dated Dec. 26, 1989. However, such connector assemblies still use individual signal contacts and individual ground pin contacts mounted separately in holes in the honeycomb grounding block.

This invention is directed to providing a unique electrical connector assembly of the character described which eliminates the need for separate ground pin contacts and which provides shielding and controlled impedance.

SUMMARY OF THE INVENTION

An object, therefore, of the invention is to provide a new and improved shielded electrical connector for interconnection to a printed circuit board having signal traces and ground traces thereon.

In the exemplary embodiment of the invention, generally, the connector includes separate signal contacts for termination to the signal traces on the printed circuit board. A conductive housing has receptacle means, including insulation means, for mounting the signal contacts therein. The grounding means are integral with the housing for interconnection to the ground circuitry on the printed circuit board, thereby eliminating the need of separate ground pin contacts.

More particularly, the housing is provided in the form of a honeycomb grounding block which is die-cast, such as of zinc alloy material. The grounding means are provided in the form of projections protruding from an outside surface of the housing or block. Standoff means are provided integral with the housing, protruding from the outside surface, for engaging the printed circuit board to space the housing from the board and to provide post-process cleaning access.

In the preferred embodiment, the projections are longer than the standoff means whereby the projections can be inserted into appropriate holes in the printed circuit board. However, the invention contemplates that the projections can be surface interconnected with the ground circuitry on the printed circuit board by means integral with the housing. The ground projections disclosed herein are generally conical in shape, with generally cylindrical tips for insertion into the holes in the printed circuit board. The receptacle means for receiving the signal contacts of the connector are provided by a plurality of receptacles arranged in a given pattern. The projections are located between the receptacles in a complementary pattern. In the exemplary embodiment, the receptacles are arranged in a pattern of rows and columns, and the projections are located at the interstices between the receptacles. In order to maximize the density, the receptacles and the projections in the rows are offset relative to the receptacles and projections in the columns.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
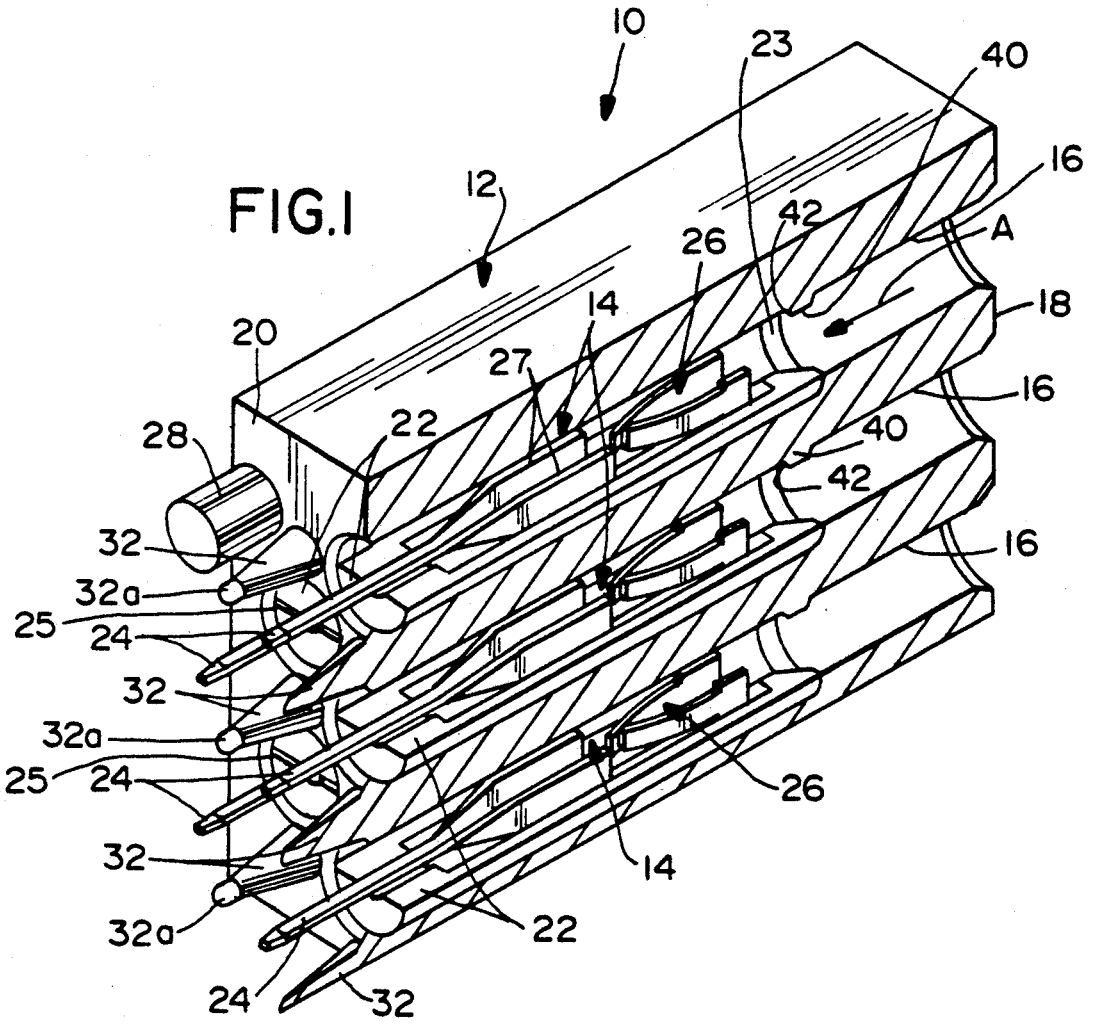
FIG. 1 is a sectioned perspective view of a portion of an electrical connector embodying the concepts of the invention.

Referring to the drawings in greater detail, and first to FIG. 1, the invention is embodied in a shielded electrical connector, generally designated 10, which includes a housing, generally designated 12, for mounting a plurality of signal contacts, generally designated 14, within a plurality of through holes 16 which extend between a top surface 18 and a bottom surface 20 of the housing. The terms "top" and "bottom" are used for reference purposes only, the connector being omnidirectional in use.

Housing 12 is a unitary, die-cast component of conductive material, such as of a zinc alloy or the like. Housing 12 could alternatively be formed by other methods such as machining metal or molding plastic and plating it with conductive plating. Insulation means are provided between contacts 14 and housing 12 in the form of split insulating sleeves 22 surrounding contacts 14 within receptacles in the form of through holes 16 in the housing. The insulating sleeves 22 are hermaphroditic and include a contact receiving cavity 15 in which the contacts 14 are located. Through holes 16 are tapered with the diameter decreasing from the bottom surface 20 to ribs 40. Insulating sleeves 22 are similarly tapered. The pin receiving end 23 of sleeves 22 as well as the pin receiving end 17 of holes 16 are believed to act as a lead in to assist in guiding any misaligned male signal pins that are being mated with the connector assembly.

Although the pair of insulating sleeves 22 without a contact 14 therein has a diameter less than the through hole 16, cavities 15 and contact 14 are dimensioned such that the contact and sleeve assembly has a greater diameter than the hole and must be press fit into the hole in an interference fit. During such press fit operation, the edges 27 of the contact 14 deform one of the cavities 15 of the plastic insulating sleeve 22 so that each contact is securely held between each pair of sleeves. As can be seen in FIG. 1, the two sleeves 22 do not contact each other and are separated by gap 25. Circular ribs 40 project annularly from within holes 16 to create a shoulder 42 which acts as a stop during the insertion of the contact and sleeve assembly from the bottom 20 of housing 10.

Figure 8:
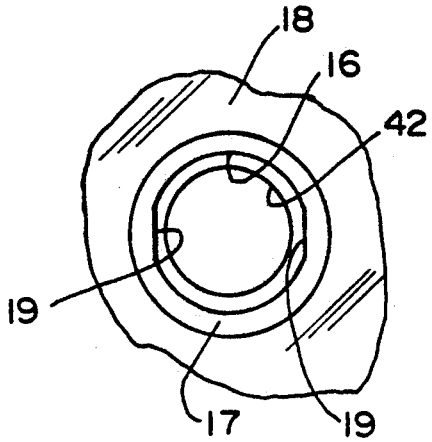
FIG. 8 is a top plan view of one of the contact and insulation sleeve receiving holes in the housing.

Each contact 14 includes a terminal portion or solder tail 24 and a receptacle portion, generally designated 26. The contact contemplated to be used with the present invention is described in further detail in copending application Ser. No. 791,867, filed Nov. 13, 1991 which is incorporated herein by reference. The solder tails are provided for insertion into appropriate holes in a printed circuit board for termination to signal traces on the board or in the holes. Receptacle portion 26 of each contact is provided for receiving a male pin from an appropriate mating connector assembly (not shown), inserted into a respective through hole 16, generally in the direction of arrow "A". It is contemplated that such mating connector assembly includes a signal pin together with a ground sleeve that contacts the hole 16 of the housing 12. Each hole 16 has a pair of diametrically opposed flat surfaces 19 (FIG. 8) located between shoulder 40 and top 18. These flat surfaces are contacted by curved resilient arms on the ground sleeve of the mating connector because the resilient arms are curved, they only contact the flat surfaces over a small surfaces area. As a result, for a given contact force, the pressure of the contact is increased which increases the reliability of the contact. The signal pin being electrically and mechanically connected to the signal wire of a shielded, coaxial lead and the ground sleeve being electrically and mechanically connected to the shield of the lead. A mating connector of this type is described in co-pending application Ser. No. 790,977, filed Nov. 13, 1991, which is incorporated herein by reference.

At this point, it should be understood that the precise configuration of housing 12, contacts 14 and insulation means 22 as shown in the drawings is exemplary and other configurations of the components are contemplated.

Figure 3:
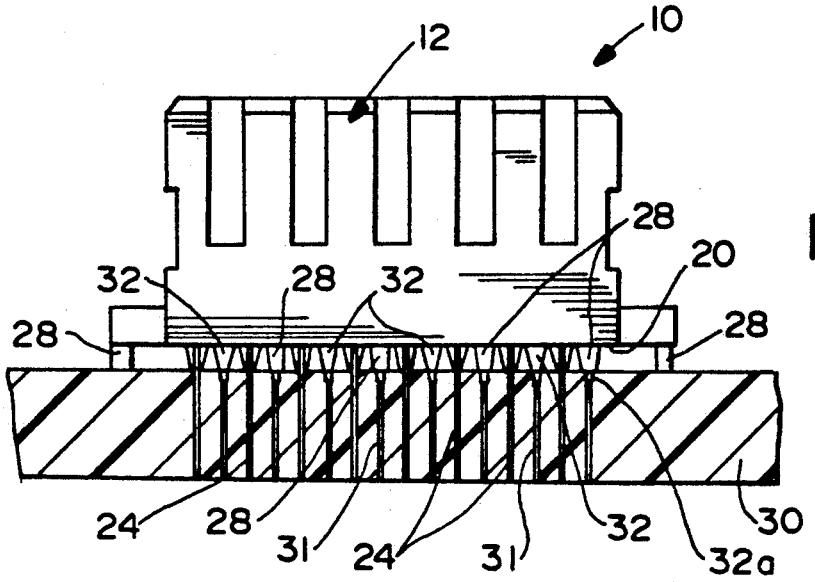
FIG. 3 is a side elevational view of the electrical connector.
Figure 2:
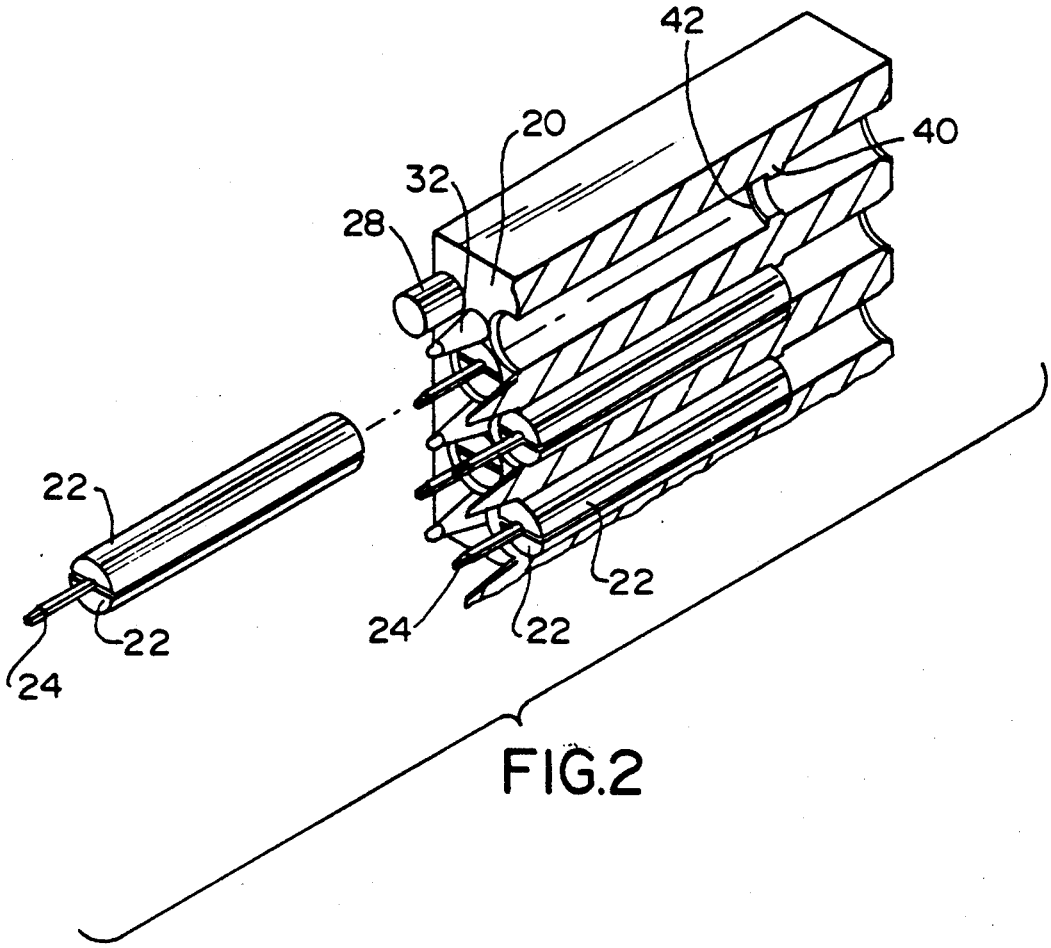
FIG. 2 is a sectioned perspective view similar to FIG. 1 with one of the contacts and insulation pairs prior to insertion into the housing.

Referring to FIGS. 2 and 3 in conjunction with FIG. 1, unitary housing 12 includes a plurality of standoffs 28 cast integral with the housing and protruding from bottom surface 20 for engaging a printed circuit board 30 to space the housing from the board. It can be seen that solder tails 24 of contacts 14 project into printed circuit board 30. As is conventional, the solder tails extend into pre-formed holes in the board, and the tails may be interconnected to signal traces connected to the holes. In addition, the signal contacts also may be surface interconnected to signal traces on the board, or even be provided with solder tails which extend slightly into recesses in the board, all of which are conventional methods of interconnecting signal contacts to signal traces on a printed circuit board.

As is known, printed circuit board 30 is provided with ground circuitry 31 in addition to the signal traces. Generally, the invention contemplates the provision of grounding means integral with housing 12 for interconnection to the ground circuitry on the board. Specifically, as best seen in FIG. 1, the grounding means are provided in the form of a plurality of ground projections 32 formed integrally with and protruding from bottom surface 20 of housing 12. The projections are generally conical in shape, with cylindrical tips **32*a* for insertion into holes in printed circuit board 30 for interconnection with the ground traces on the printed circuit board. The tips 32*a* of the ground projections are soldered to the ground circuitry to complete a ground circuit with unitary die-cast housing 12. As with the signal contacts, the ground projections 32 may extend through holes in the printed circuit board, into recesses that project part way into the printed circuit board or may be surface mounted to the surface of the printed circuit board. With the conductive housing surrounding the signal contacts 14**, the signal contacts are effectively shielded to prevent or reduce crosstalk between the contacts, without providing any separate or independent ground contact pins.

Figure 4:
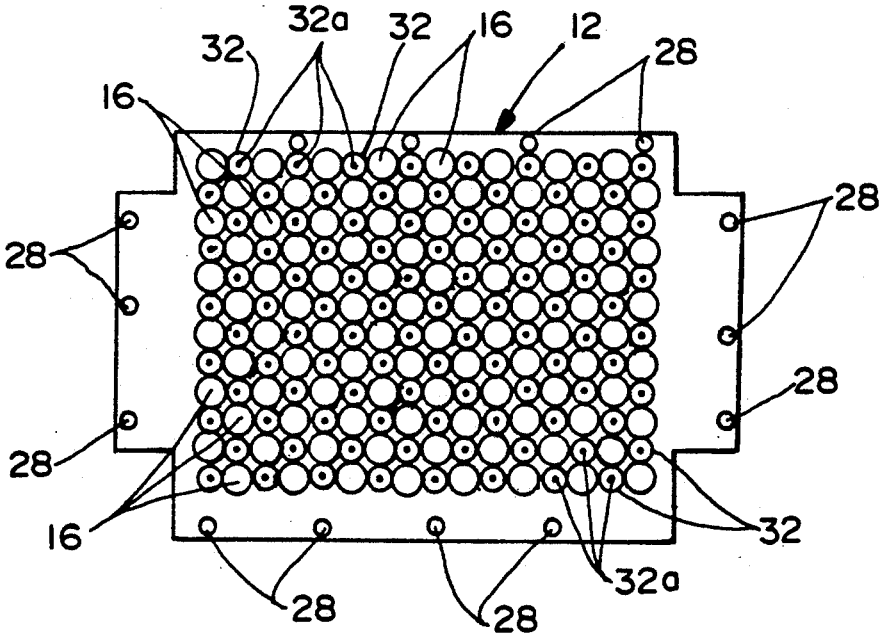
FIG. 4 is a bottom plan view of the electrical connector, illustrating the pattern of signal terminals and ground projections.
Figure 5:
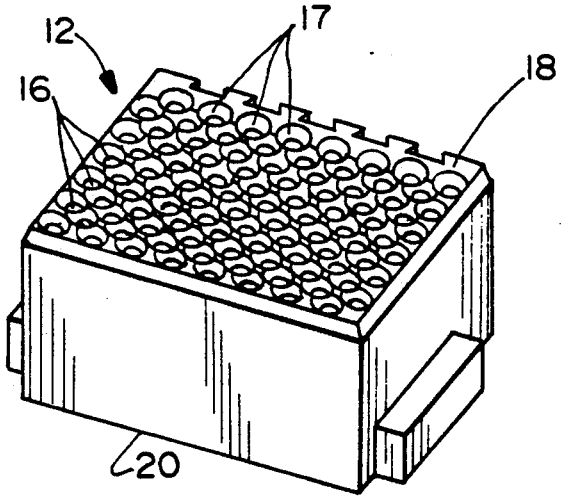
FIG. 5 is a perspective view of the housing of the present invention taken from the side opposite that of FIG. 3.
Figure 6:
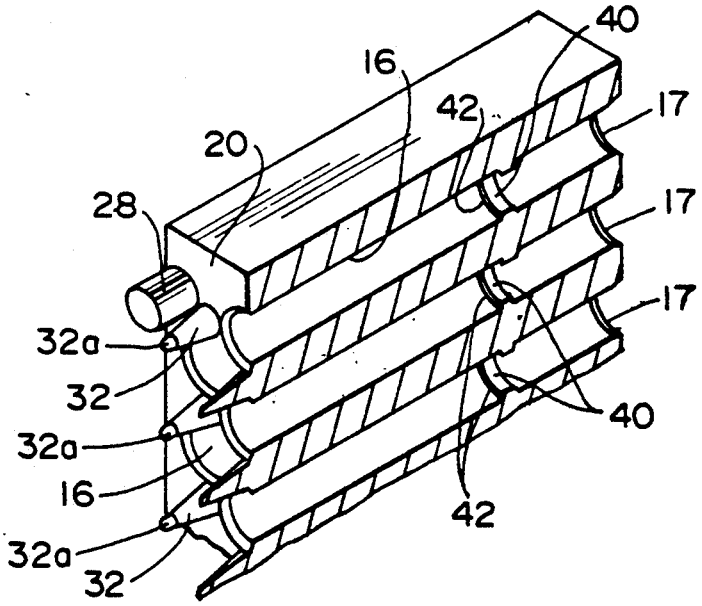
FIG. 6 is a sectioned perspective view of a portion of the housing of FIG. 5.
Figure 7:
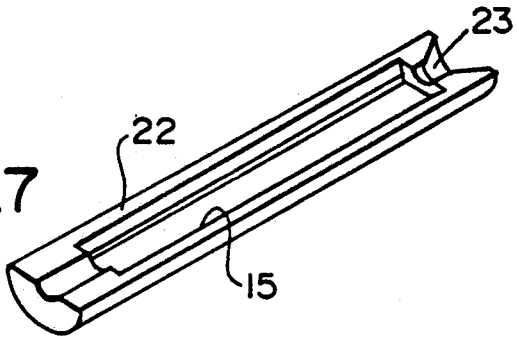
FIG. 7 is one half of the insulation sleeves of the present invention.

FIG. 4 shows a bottom plan view of housing 12. It can be seen that receptacles or through holes 16 are arranged in a given pattern to form the housing in sort of a honeycomb grounding block. As illustrated, the receptacles or through holes 16 are arranged in a plurality of rows and columns. Ground projections 32 are shown located between the receptacles in a complementary pattern, namely between the rows and columns, and specifically at the interstices between the receptacles. With the pattern illustrated, the receptacles and projections in the rows are offset relative to the receptacles and projections in the columns. Consequently, an extremely dense array of signal contacts is provided. In addition, the large number of ground projections 32 provides a great deal of redundancy with respect to completing the ground circuit. As a result, poor contact between some of the projections and the ground circuitry or even elimination of up to 25% of the ground projections will not significantly affect the performance of the connector system, thereby providing high reliability. The ground projections also provide a shield "matrix" which encompasses individual signal pins in their transition from honeycombed grounding block to termination on the printed circuit board, thus further reducing the possibility of crosstalk and maintaining a controlled impedance through the transition.

In actual practice, as many as 96 signal contacts and 96 ground projections have been provided in less than 0.5 square inches of given space. This extremely high density configuration is afforded by the invention without any separate components for ground pin contacts. Not only is a very high density afforded, but it readily can be understood that the connector is very cost-effective because separate ground pin contacts need not be fabricated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector for interconnection to a printed circuit board having signal traces and ground circuitry thereon, the connector including an array of signal contacts for termination to the signal traces on the printed circuit board, a conductive housing having receptacle means for mounting the signal contacts therein, said receptacle means including a plurality of generally cylindrical receptacles, and insulation means including a plurality of insulation members for insulating each said signal contact from said housing, wherein the improvement comprises:

grounding means integrally formed with the housing and located within said array of signal contacts for interconnection to the ground circuitry on the printed circuit board, said grounding means including a plurality of projections extending from an outside surface of said housing configured to be positioned adjacent said printed circuit board, each projection being generally positioned between four adjacent receptacles.

2. In an electrical connector as set forth in claim 1, wherein said housing comprises a unitary molded component.

3. In an electrical connector as set forth in claim 2, wherein said housing is fabricated of a zinc die-cast alloy.

4. In an electrical connector as set forth in claim 1, wherein said projections protrude from an outside surface of the housing.

5. In an electrical connector as set forth in claim 4, including standoff means integral with the housing protruding from said surface for engaging the printed circuit board to space the housing therefrom.

6. In an electrical connector as set forth in claim 5, wherein said projections are longer than said standoff means whereby the projections can be inserted into appropriate recesses in the printed circuit board.

7. In an electrical connector as set forth in claim 6, wherein said projections are generally conical in shape, with generally cylindrical tips for insertion into the recesses in the printed circuit board.

8. In an electrical connector as set forth in claim 4, wherein the receptacles are arranged in a given pattern, and said projections are located between the receptacles in a complementary pattern.

9. In an electrical connector as set forth in claim 8, wherein the receptacles are arranged in a pattern or rows and columns, and said projections are located at the interstices between the receptacles.

10. In an electrical connector as set forth in claim 9, wherein the receptacles and projections in each row are offset relative to the receptacles and projections in adjacent rows.

11. A shielded electrical connector for interconnection to a printed circuit board having signal traces and ground circuitry thereon, comprising the combination of a plurality of signal contacts for termination to the signal traces on the printed circuit board, a conductive housing having a plurality of generally cylindrical receptacle means for mounting the signal contacts therein, said receptacle means being positioned so as to create intersection areas between at least three adjacent receptacle means, insulation means insulating said contacts from said housing and grounding means formed integrally with the housing for interconnection to the ground circuitry on the printed circuit board, said grounding means including a plurality of projections protruding from an outside surface of said housing configured to be positioned adjacent said printed circuit board, each said projection being located generally at the intersection area between at least three adjacent receptacle means.

12. The electrical connector of claim 11 wherein said housing comprises a unitary die-cast component.

13. The electrical connector of claim 12 wherein said housing further includes standoff means integral with the housing protruding from said surface for engaging the printed circuit board to space the housing therefrom, the projections being longer than the standoff means whereby the projections can be inserted into appropriate recesses in the printed circuit board.

14. The electrical connector of claim 13 wherein said projections are generally conical in shape, with generally cylindrical tips for insertion into the recesses in the printed circuit board.

15. The electrical connector of claim 13 wherein the receptacle means of the connector comprise a plurality of receptacles arranged in a given pattern, and said projections are located between the receptacles in a complementary pattern.

16. The electrical connector of claim 15 wherein the receptacles are arranged in a pattern of rows and columns, and said projections are located at the interstices between the receptacles.

17. The electrical connector of claim 11 wherein the receptacle means of the connector comprise a plurality of receptacles arranged in a given pattern, and said grounding means are located between the receptacles in a complementary pattern.

18. The electrical connector of claim 17 wherein the receptacles are arranged in a pattern of rows and columns, and said grounding means are located at the interstices between the receptacles.

19. The electrical connector of claim 18 wherein the receptacles and grounding means in each row are offset relative to the receptacles and grounding means in the adjacent rows.

20. The electrical connector of claim 11 wherein said conductive housing is provided in the form of a honeycomb grounding block with aid receptacle means comprising holes in the block.

21. A shielded electrical connector assembly for interconnection to a printed circuit board having signal circuitry and ground circuitry thereon, comprising:

a plurality of signal contacts for termination to appropriate mating signal components and for soldering to said signal circuitry;

a conductive housing for mounting the signal contacts therein, said conductive housing having a plurality of generally cylindrical receptacles arranged in a generally uniform array for receiving said signal contacts, and a plurality of ground projections integrally formed with said conductive housing and extending from an outside surface of said thereof that is configured to be positioned adjacent said printed circuit board, said projections being positioned within said array for soldering to said ground circuitry, each projection being generally conical in shape and generally positioned between four adjacent receptacles; and said signal contacts being insulated from said conductive housing by a plurality of insulating means, each being positionable within one of said receptacles.

* * * * *

UNITED STATES PATENT AND TRADEMARK OFFICE

CERTIFICATE OF CORRECTION

PATENT NO. : 5,162,001

DATED : November 10, 1992

INVENTOR(S) : Frank A. Harwath, et al.

It is certified that error appears in the above—identified patent and that said Letters Patent is hereby corrected as shown below:

On the title page, item [73]:

Assignee: Molex Incorporated, Lisle, Ill.

to

Assignee: Molex Incorporated, Lisle, Ill., International Business Machines, Poughkeepsie, NY Signed and Sealed this Twenty-seventh Day of February, 1996

*Attest:*

*Attesting Officer*

BRUCE LEHMAN

*Commissioner of Patents and Trademarks*